US006851257B1

(12) United States Patent
Yoshida et al.

(10) Patent No.: US 6,851,257 B1
(45) Date of Patent: Feb. 8, 2005

(54) EXHAUST GAS PASSAGE STRUCTURE OF OUTBOARD ENGINE

(75) Inventors: Hiroyuki Yoshida, Wako (JP); Tomonori Ikuma, Wako (JP); Hideaki Takada, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/070,447

(22) PCT Filed: Sep. 22, 2000

(86) PCT No.: PCT/JP00/06533

§ 371 (c)(1),
(2), (4) Date: Mar. 20, 2002

(87) PCT Pub. No.: WO01/21943

PCT Pub. Date: Mar. 29, 2001

(30) Foreign Application Priority Data

Sep. 24, 1999 (JP) ..... 11-270881
Sep. 24, 1999 (JP) ..... 11-270882

(51) Int. Cl.[7] ..... F01N 3/10

(52) U.S. Cl. ..... 60/299; 60/302; 440/88 R; 440/89 R

(58) Field of Search ..... 60/285, 295, 299, 60/302, 320; 123/195 P; 440/88 R, 89 R, 900, 89 F

(56) References Cited

U.S. PATENT DOCUMENTS 4,811,560 A * 3/1989 Nakase et al. ..... 60/320
5,174,112 A * 12/1992 Sougawa et al. ..... 60/302
5,239,825 A * 8/1993 Shibata ..... 60/302
5,366,401 A * 11/1994 Nanami et al. ..... 440/89 R
5,378,180 A 1/1995 Nakayama et al.
5,554,060 A * 9/1996 Koishikawa et al. ..... 440/89
5,595,516 A * 1/1997 Matsumoto et al. ..... 440/89
5,916,135 A * 6/1999 Yoshida et al. ..... 60/302
6,053,785 A * 4/2000 Kato et al. ..... 440/89
2001/0029734 A1 * 10/2001 Kato ..... 60/285

FOREIGN PATENT DOCUMENTS

| | | | |
|---|---|---|---|
| DE | 43 01 286 A1 | | 7/1993 |
| DE | 44 32 915 A1 | | 3/1995 |
| EP | 0 839 711 A1 | | 5/1998 |
| JP | 63-212199 | | 9/1988 |
| JP | 6-159073 | | 6/1994 |
| JP | 7-81686 | | 3/1995 |
| JP | 08-040382 | * | 2/1996 |
| JP | 8-100625 | | 4/1996 |
| JP | 8-312365 | | 11/1996 |

OTHER PUBLICATIONS

Supplemental European Search Report.

* cited by examiner

*Primary Examiner*—Tu M. Nguyen
(74) *Attorney, Agent, or Firm*—Arent Fox, PLLC

(57) ABSTRACT

A split face of an exhaust passage-defining member is coupled to a split face provided at a rear portion of an oil case interposed between an engine block and an extension case. A main exhaust gas expansion chamber and a subsidiary exhaust gas expansion chamber are defined between the exhaust passage-defining member and the oil case, so that an exhaust gas supplied from a first exhaust passage in the oil case is discharged into a second exhaust passage in the oil case via the main exhaust gas expansion chamber. A portion of the exhaust gas in the main exhaust gas expansion chamber is passed through a communication bore and the subsidiary exhaust gas expansion chamber and discharged from an exhaust outlet into the air.

8 Claims, 14 Drawing Sheets

LONGITUDINAL DIRECTION
REAR
FRONT
3
3
O
S
E

EXHAUST GAS PASSAGE STRUCTURE OF OUTBOARD ENGINE

FIELD OF THE INVENTION

The present invention relates to an exhaust passage structure in an outboard engine system in which at least a portion of an exhaust passage is integrally defined in a case member having a drive shaft accommodated therein for transmitting a driving force from an engine to a propeller, and to an exhaust passage structure in an outboard engine system in which a catalytic converter for purifying an exhaust gas discharged from the engine is mounted in the exhaust passage for guiding the exhaust gas.

BACKGROUND ART

In general, an outboard engine system includes an engine room in which an engine is accommodated, and a case member extending downwards from the engine room to accommodate a drive shaft driven by the engine, so that an exhaust gas discharged from the engine is guided downwards within the case member and discharged into water in order to enhance the silencing effect. During idling operation of the engine, a portion of the exhaust gas is diverted and discharged into the air, thereby providing a reduction in back pressure.

There is such a conventionally known outboard engine system described in Japanese Patent Application Laid-open No.8-100625, in which an exhaust passage having a silencing effect is formed by an exhaust gas expansion chamber having an outlet and an inlet.

It should be noted here that if the exhaust gas expansion chamber is integrally formed in the case member in the outboard engine system, the following problem is encountered: It is necessary to change the design of the entire case member or to replace the entire case member, which is a large-sized part, in order to regulate the silencing effect, resulting in a remarkable increase in cost.

The case member in the outboard engine system is generally comprised of a cylindrical extension case, a mount case coupled to an upper end of the extension case to support an engine block, and a gear case coupled to a lower end of the extension case. If the exhaust gas expansion chamber is integrally formed in the case member, it is necessary to disassemble the case member for the purpose of carrying out the maintenance of the exhaust gas expansion chamber. However, the following problem is encountered: The cases forming the case member are large-sized parts each having a large weight and moreover, are supported on a mounting bracket for supporting the outboard engine system on a hull through an elastic mount device. For this reason, to separate the cases, an extremely troublesome operation is required, resulting in a reduction in maintenance property.

Particularly, if the outboard engine system includes a 4-cycle engine, and an oil pan is provided within the case member, the following problem arises: The oil pan and the exhaust gas expansion chamber interfere with each other and thus, it is difficult to sufficiently ensure volumes of the oil pan and the exhaust gas expansion chamber.

An outboard engine system is known from Japanese Patent Application Laid-open No.8-312365, which includes a catalytic converter mounted in an exhaust passage provided in a case member for purifying an exhaust gas. In this outboard engine system, the catalytic converter includes an upstream introducing exhaust pipe and a downstream discharging exhaust pipe, and a mounting flange at an upper end of the introducing exhaust pipe is fixed by bolting within the case member.

It should be noted here that in the outboard engine system described in Japanese Patent Application Laid-open No.8-312365, the case member is comprised of a cylindrical extension case, a mount case coupled to an upper end of the extension case to support an engine block, and a gear case coupled to a lower end of the extension case. The catalytic converter is accommodated within the extension case and hence, to subject the catalytic converter to the maintenance, it is necessary to separate the mount case from the extension case. However, the following problem is encountered: The mount case and the extension case are large-sized parts each having a large weight and moreover, they are supported on the mounting bracket for supporting the outboard engine system on a hull through an elastic mount device. For this reason, an extremely troublesome operation is required to separate the mount case and the extension case from each other, resulting in a reduction in maintenance property.

DISCLOSURE OF THE INVENTION

The present invention has been accomplished with the above circumstances in view, and it is a first object of the present invention to enhance the exhaust silencing effect, while ensuring the maintenance property of the exhaust passage in the outboard engine system.

It is also a second object of the present invention to enhance the maintenance property of the catalytic converter mounted in the exhaust passage in the outboard engine system.

To achieve the first object, according to the present invention, there is proposed an exhaust passage structure in an outboard engine system, in which at least a portion of an exhaust passage is integrally formed in a case member having a drive shaft accommodated therein for transmitting a driving force from an engine to a propeller, characterized in that openings of the exhaust passage are defined in a sidewall of the case member, and an exhaust passage forming an exhaust silencing portion is defined between the case member and a lid detachably coupled to cover the openings.

With the above arrangement, the exhaust passage forming the exhaust silencing portion is defined between the case member and the lid detachably coupled to cover the opening in the sidewall of the case member. Therefore, the degree of freedom for designing the exhaust silencing portion can be increased to enhance the exhaust silencing effect, as compared with a case where the exhaust silencing portion is formed within the case member. Moreover, the exhaust passage can be exposed for maintenance only by separating the lid from the case member without disassembling of the case member, leading to a remarkable enhancement in maintenance property.

To achieve the first object, in addition to the above arrangement, there is proposed an exhaust passage structure in an outboard engine system, wherein an oil pan for storing a lubricating oil for the engine is integrally formed within the case member.

With the above arrangement, even when the oil pan for storing the lubricating oil for the engine is integrally formed within the case member, the maintenance of the exhaust passage can be carried out only by separating the lid from the case member, without being hindered by the oil pan. Moreover, it is possible to avoid the interference of the oil pan and the exhaust silencing portion with each other to sufficiently ensure volumes of the oil pan and the exhaust silencing portion.

To achieve the second object, according to the present invention, there is proposed an exhaust passage structure in an outboard engine system in which a catalytic converter for purifying an exhaust gas discharged from an engine is mounted in an exhaust passage for guiding the exhaust gas, characterized in that at least a portion of the exhaust passage is integrally formed in a case member having a drive shaft accommodated therein for transmitting a driving force from the engine to a propeller; a connection into which the exhaust passage opens is formed in a sidewall of the case member; and the catalytic converter is disposed in a space surrounded by the case member and a lid detachably coupled to the connection to permit the exhaust gas to flow.

With the above arrangement, the catalytic converter is disposed in the space surrounded by the case member and the lid detachably coupled to the connection in the sidewall of the case member. Therefore, the catalytic converter can be exposed for the maintenance only by separating the lid from the case member without disassembling of the case member, leading to a remarkable enhancement in maintenance property.

To achieve the second object, in addition to the above arrangement, there is proposed an exhaust passage structure in an outboard engine system, wherein the catalytic converter is supported on the lid.

With the above arrangement, the catalytic converter is supported on the lid. Therefore, the handleability and assemblability of the catalytic converter can be enhanced by previously assembling the catalytic converter to the lid to form a subassembly, but also the catalytic converter can be separated from the case member together with the lid, leading to a further enhancement in maintenance property.

To achieve the second object, in addition to the above arrangement, there is proposed an exhaust passage structure in an outboard engine system, wherein the catalytic converter is supported on th case member.

With the above arrangement, the catalytic converter is supported on the case member. Therefore, even if the lid is separated from the case member, the exhaust passage leading to the catalytic converter is not cut off and hence, the seal structure for the exhaust passage can be simplified.

To achieve the second object, according to the present invention, there is proposed an exhaust passage structure in an outboard engine system in which a catalytic converter for purifying an exhaust gas discharged from a 4-cycle engine is mounted in an exhaust passage for guiding the exhaust gas, characterized in that at least a portion of the exhaust passage and an oil pan for restoring a lubricating oil for the engine are integrally formed in a case member having a drive shaft accommodated therein for transmitting a driving force from the engine to a propeller; a connection into which the exhaust passage opens is formed in a sidewall of the case member; and the catalytic converter is disposed in a space surrounded by the case member and a lid detachably coupled to the connection to permit the exhaust gas to flow.

With the above arrangement, the catalytic converter is disposed in the space surrounded by the case member and the lid detachably coupled to the connection on the sidewall of the case member. Therefore, the catalytic converter can be exposed for the maintenance only by separating the lid from the case member without disassembling of the case member, leading to a remarkable enhancement in maintenance property. Particularly, even when the oil pan for storing the lubricating oil for the engine is integrally formed in the case member, the maintenance property of the catalytic converter cannot be impeded by the oil pan.

An oil case 41 in embodiments corresponds to the case member of the present invention; an exhaust passage-defining member 48 in the embodiments corresponds to the lid of the present invention; and communication bores $e_2$ and $e_4$ in the embodiment corresponds to the openings of the present invention.

BRIEF DESCRIPTION OF THE DRAWINGS

FIGS. 1 to 7 show a first embodiment of the present invention, wherein

FIG. 1 is a side view of the entire arrangement of an outboard engine system;

FIG. 2 is an enlarged sectional view of an essential portion shown in FIG. 1;

FIG. 3 is a sectional view taken along a line 3—3 in FIG. 2;

FIG. 4 is an enlarged view taken along a line 4—4 in FIG. 1;

FIG. 5 is an enlarged view of the essential portion shown in FIG. 2;

FIG. 6 is a view taken along a line 6—6 in FIG. 5; and

FIG. 7 is a view taken along a line 7—7 in FIG. 5.

FIGS. 8 to 10 show a second embodiment, wherein

FIG. 8 is a view similar to FIG. 5, but showing the second embodiment;

FIG. 9 is a view taken along a line 9—9 in FIG. 8; and

FIG. 10 is a view taken along a line 10—10 in FIG. 8.

FIGS. 11 to 15 show a third embodiment of the present invention, wherein FIG. 11 is a view similar to FIG. 5, but showing the third embodiment;

FIG. 12 is a view taken in a line 12—12 in FIG. 11;

FIG. 13 is a view taken along a line 13—13 in FIG. 11;

FIG. 14 is a side view of a catalytic converter; and

FIG. 15 is view taken in the direction of an arrow 15 in FIG. 14.

BEST MODE FOR CARRYING OUT THE INVENTION

A first embodiment of the present invention will now be described with reference to FIGS. 1 to 7.

Figure 1:
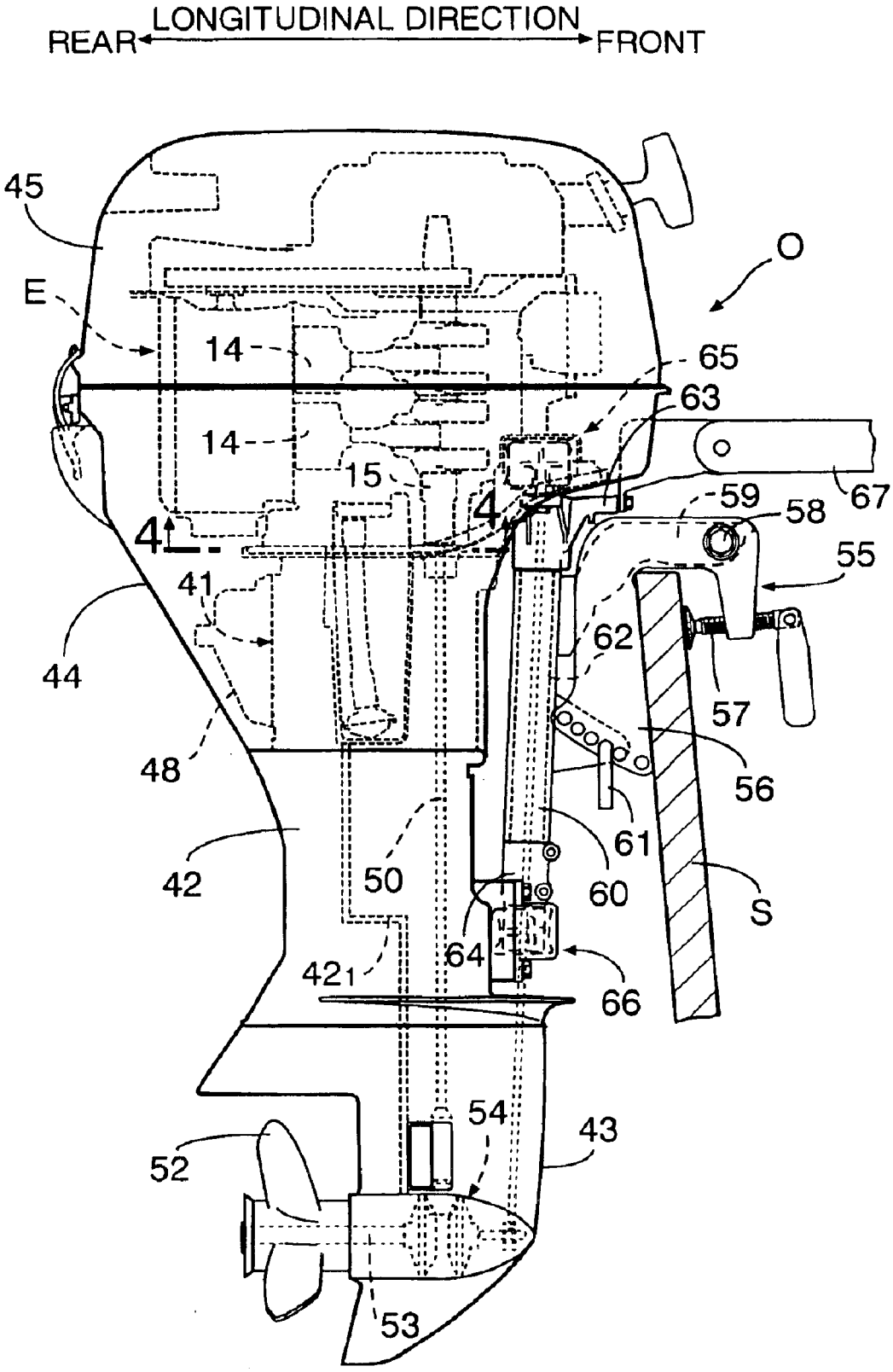
Figure 2:
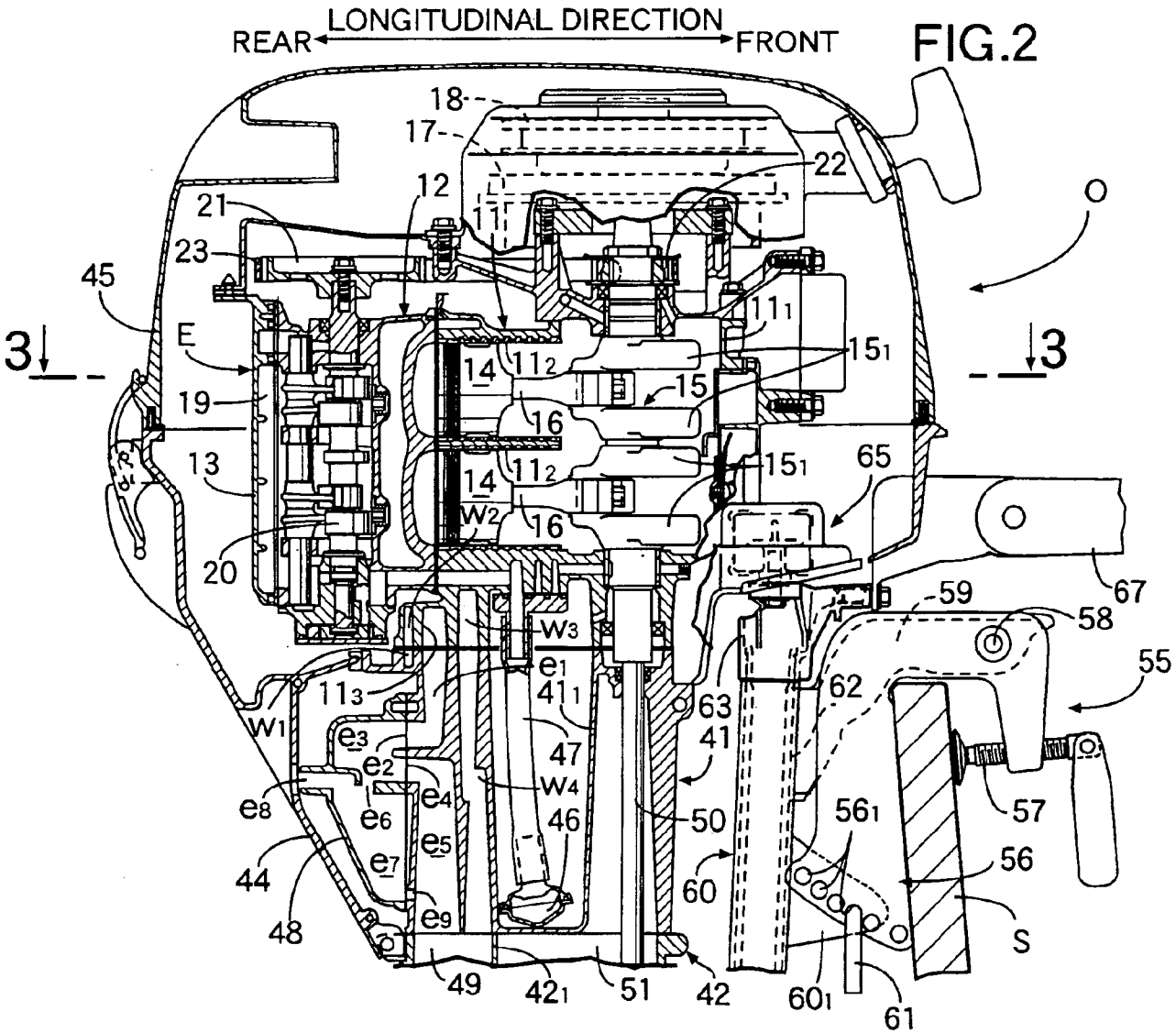
Figure 3:
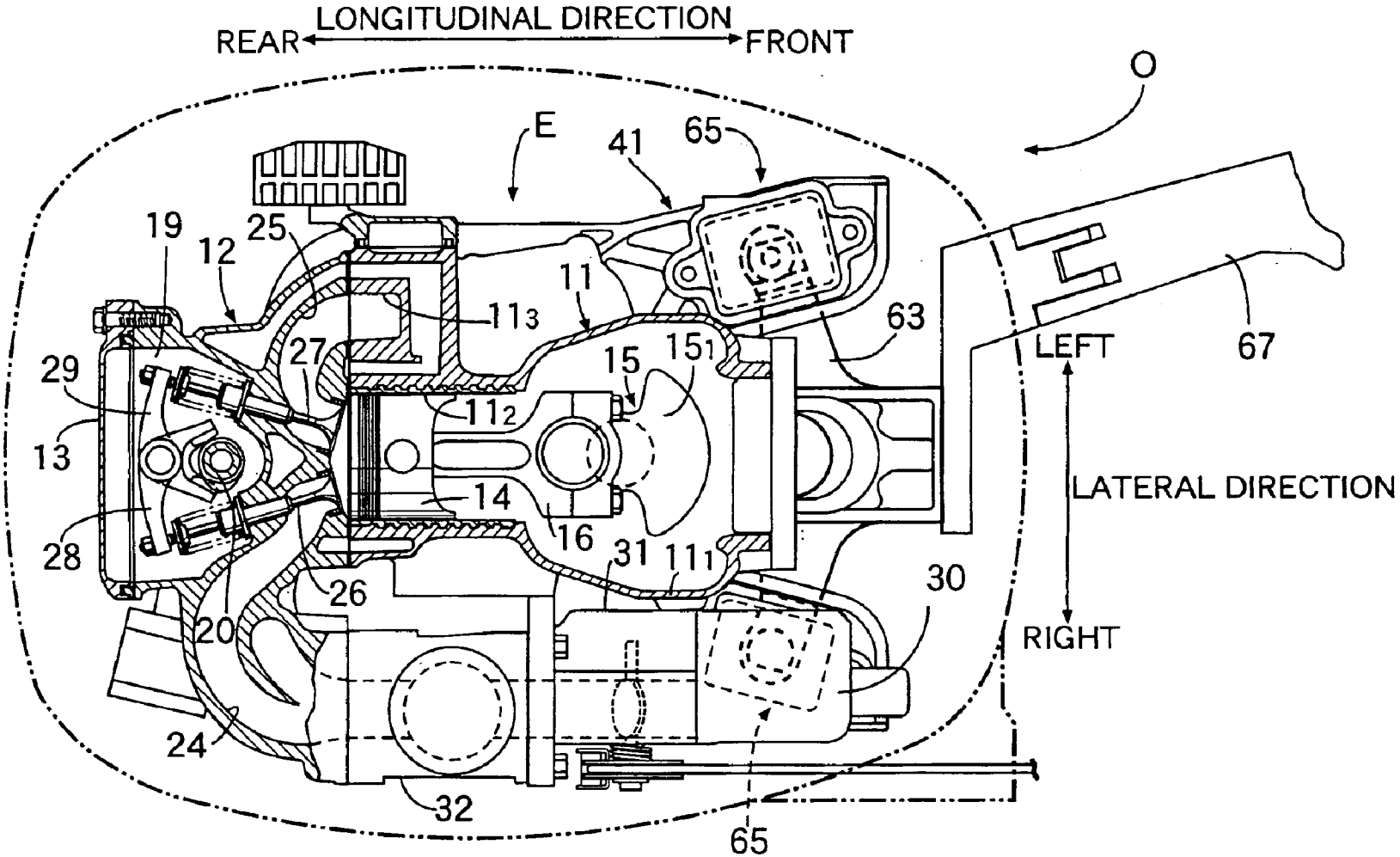

As shown in FIGS. 1 to 3, a 2-cylinder and 4-cycle engine E mounted at an upper portion of an outboard engine system O includes an engine block 12 integrally provided with a crankcase $\mathbf{11}_1$ and two upper and lower cylinder bores $\mathbf{11}_2$, $\mathbf{11}_2$, a cylinder head 12 coupled to the engine block 11, and a head cover 13 coupled to the cylinder head 12. Two pistons 14, 14 slidably received in the two cylinder bores $\mathbf{11}_2$, $\mathbf{11}_2$ defined in the engine block 11 are connected through connecting rods 16, 16 to a crankshaft 15 supported in the engine block 11.

A generator 17 and a recoil starter 18 are mounted coaxially on an end of the crankshaft 15 protruding upwards from the engine block 11. A camshaft 20 is supported in a valve-operating chamber 19 defined between the cylinder head 12 and the head cover 13, and a cam pulley 21 mounted at an upper end of the camshaft 20 and a crank pulley 22 mounted at an upper portion of the crankshaft 15 are connected to each other by a timing belt 23. An intake valve 26 and an exhaust valve 27 for opening and closing an intake port 24 and an exhaust port 25 defined in the cylinder head 12 respectively are connected to the camshaft 20 through an intake rocker arm 28 and an exhaust rocker arm 29, respectively. An intake silencer 30, a choke valve 31 and a variable Venturi-type carburetor 32 disposed on a right side of the engine E are connected to the intake port 24.

An axis of the crankshaft 15 is disposed vertically, and axes of the cylinder bores $\mathbf{11}_2$, $\mathbf{11}_2$ are disposed longitudinally, so that a portion of each cylinder bore $\mathbf{11}_2$ on the side of the crankcase $\mathbf{11}_1$ faces forwards and a portion of each cylinder bore $\mathbf{11}_2$ on the side of the cylinder heads 12 faces rearwards. The crank phases of the two pistons 14, 14 are the same as each other, and the ignition timings provided by the pistons 14, 14 are deviated from each other by 360°. Counterweights $\mathbf{15}_1$ having a balance rate of 100% for opposing the reciprocal movement mass of the pistons 14, 14 are mounted on the crankshaft 15.

An upper surface of an oil case 41 is coupled to a lower surface of the engine E having the above-described structure, and an upper surface of an extension case 42 is coupled to a lower surface of the oil case 41. An upper surface of a gear case 43 is coupled to a lower surface of the extension case 42. An outer periphery of the oil case 41 and an outer periphery of a lower half of the engine E are covered with an undercover 44 coupled to an upper end of the extension case 42, and an upper half of the engine E is covered with an engine cover 45 coupled to an upper end of the undercover 44.

As can be seen from FIG. 2, the oil case 41 is integrally provided with an oil pan $\mathbf{41}_1$, and a suction pipe 47 provided with an oil strainer 46 is accommodated in the oil pan $\mathbf{41}_1$. An exhaust passage-defining member 48 is coupled to a rear surface of the oil case 41, and an exhaust gas expansion chamber 49 is defined in the extension case 42 through a partition wall $\mathbf{42}_1$.

A drive shaft 50 connected to a lower end of the crankshaft 15 is passed through the oil case 41, extends downwards within a drive shaft chamber 51 defined in the extension case 42, and is connected through a forward/backward changeover mechanism 54 to a front end of a propeller shaft 53 which is provided at its rear end with a propeller 52 and supported longitudinally on the gear case 43.

A mounting bracket 55 for detachably mounting the outboard engine system O to a hull S includes an inverted J-shaped mounting bracket body 56 and a set screw 57 threadedly engaged with the mounting bracket body 56. A swinging arm 59 is pivotally supported at its front end on the mounting bracket body 56 through a pivot pin 58, and a pipe-shaped swivel case 60 is integrally coupled to a rear end of the swinging arm 59. A large number of pinholes $\mathbf{56}_1$ are provided in the mounting bracket body 56, so that the tilting angle of the outboard engine system O about the pivot pin 58 can be regulated by inserting a pin 61 through a pinhole made in a locking plate $\mathbf{60}_1$ fixed to the swivel case 60 and any one of the pinholes $\mathbf{56}_1$ in the mounting bracket body 56.

A swivel shaft 62 relatively rotatably fitted in the swivel case 60 includes a mount frame 63 and a mount block 64 at its upper and lower ends, respectively. The upper mount frame 63 is resiliently connected to the oil case 41 through a pair of left and right upper mounts 65, 65, and the lower mount block 64 is resiliently connected to the extension case 42 through a lower mount 66. A steering handlebar 67 is fixed to a front end of the oil case 41, so that the oil case 41 can be swung laterally about the swivel shaft 62 to steer the outboard engine system O by grasping the steering handlebar 67 to operate it laterally.

Figure 4:
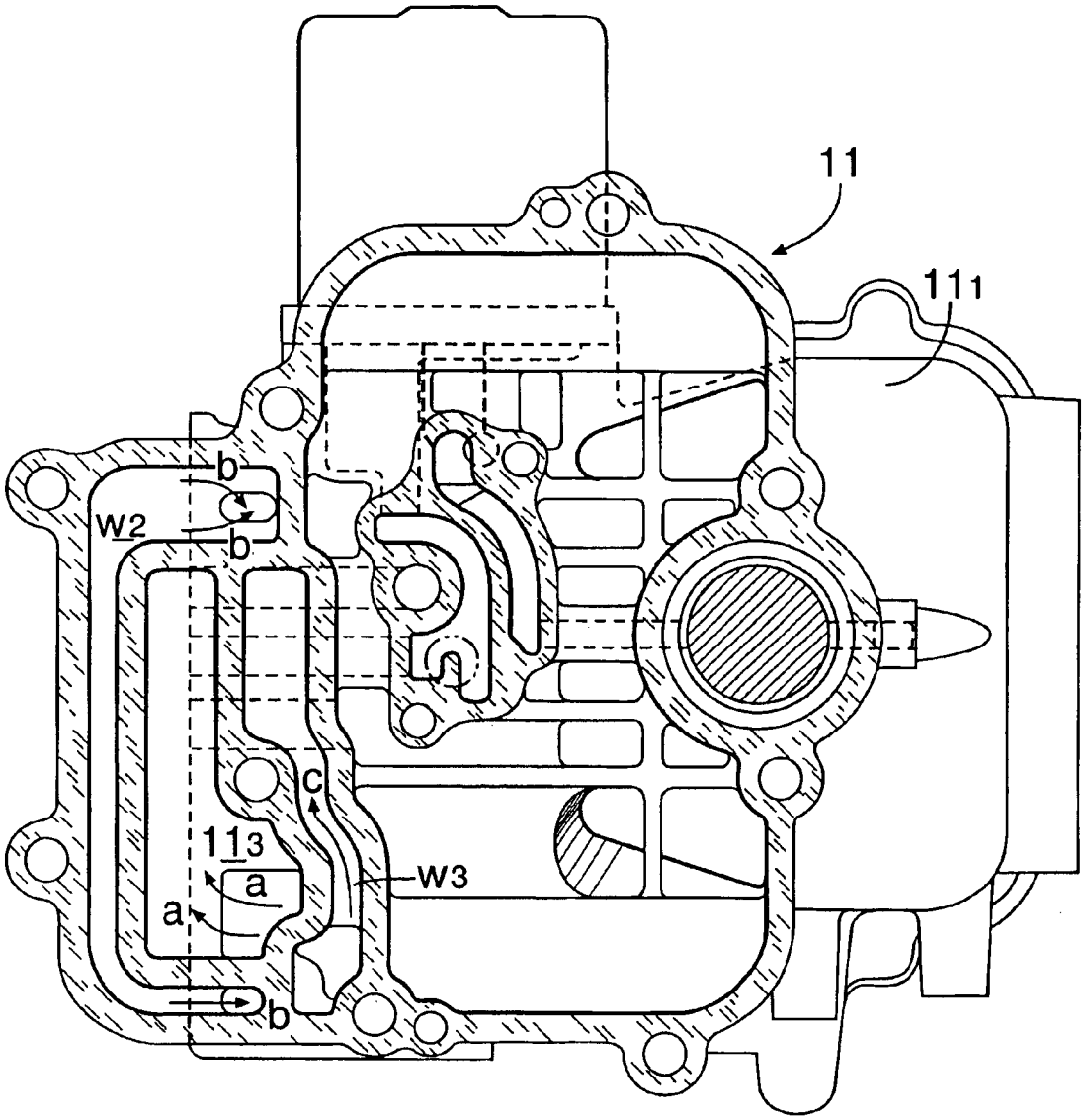

As can be seen from FIGS. 2 and 4, cooling water pumped by a cooling water pump (not shown) is supplied cooling-water passages $w_1$ and $w_2$ defined in a mating surfaces of the engine block 11 and the oil case 41, and is bifurcated therefrom and supplied to the engine block 11 and the cylinder head 12 (see an arrow b in FIG. 4). The cooling water, which has cooled the engine block 11 and the cylinder head 12, is supplied to a cooling-water passage $w_3$ defined in a lower surface of the engine block 11 (see an arrow c in FIG. 4), and is passed therefrom through a cooling-water passage $w_4$ defined in the oil case 41 and is discharged into the extension case 42.

Figure 5:
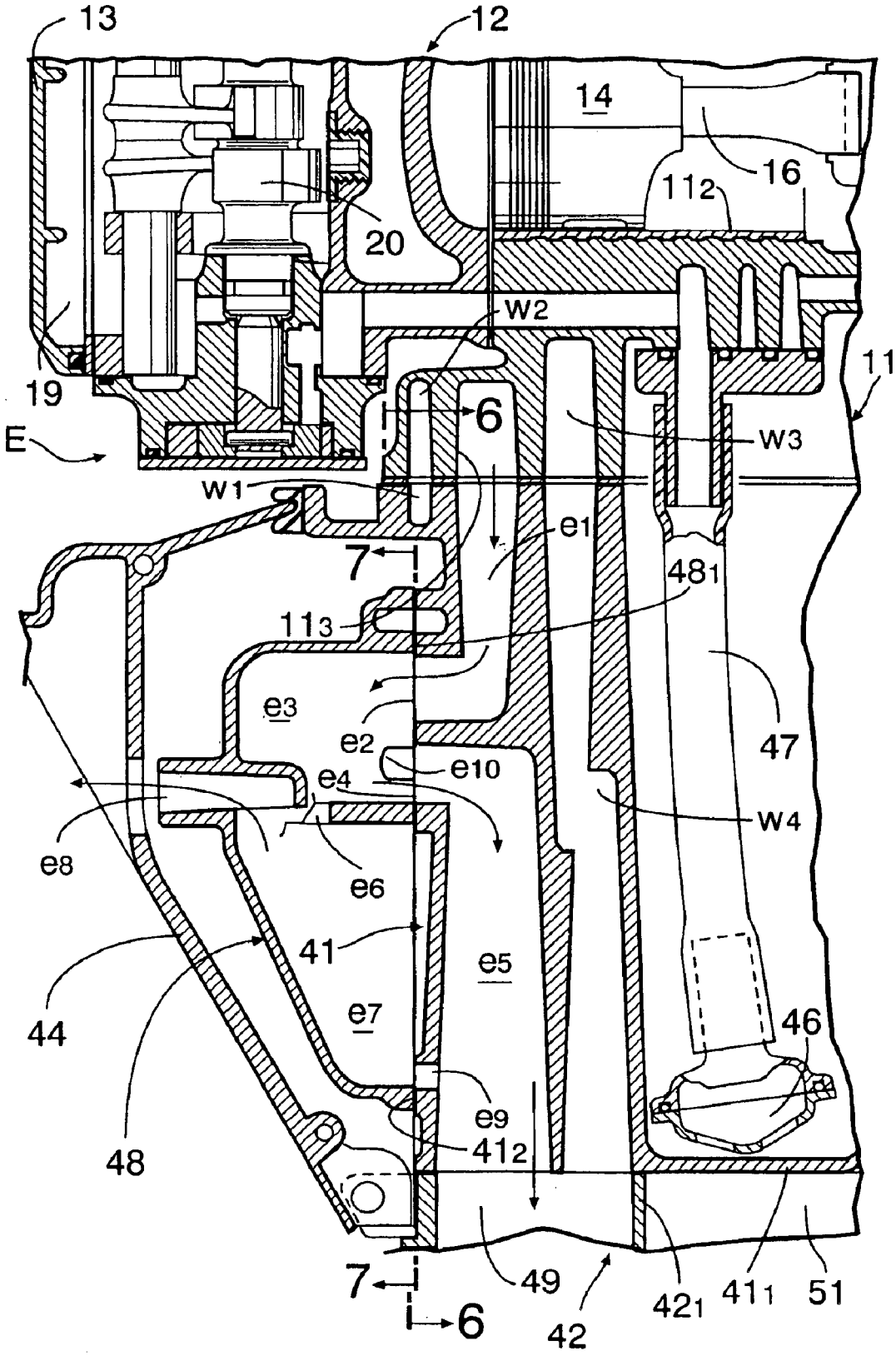
Figure 6:
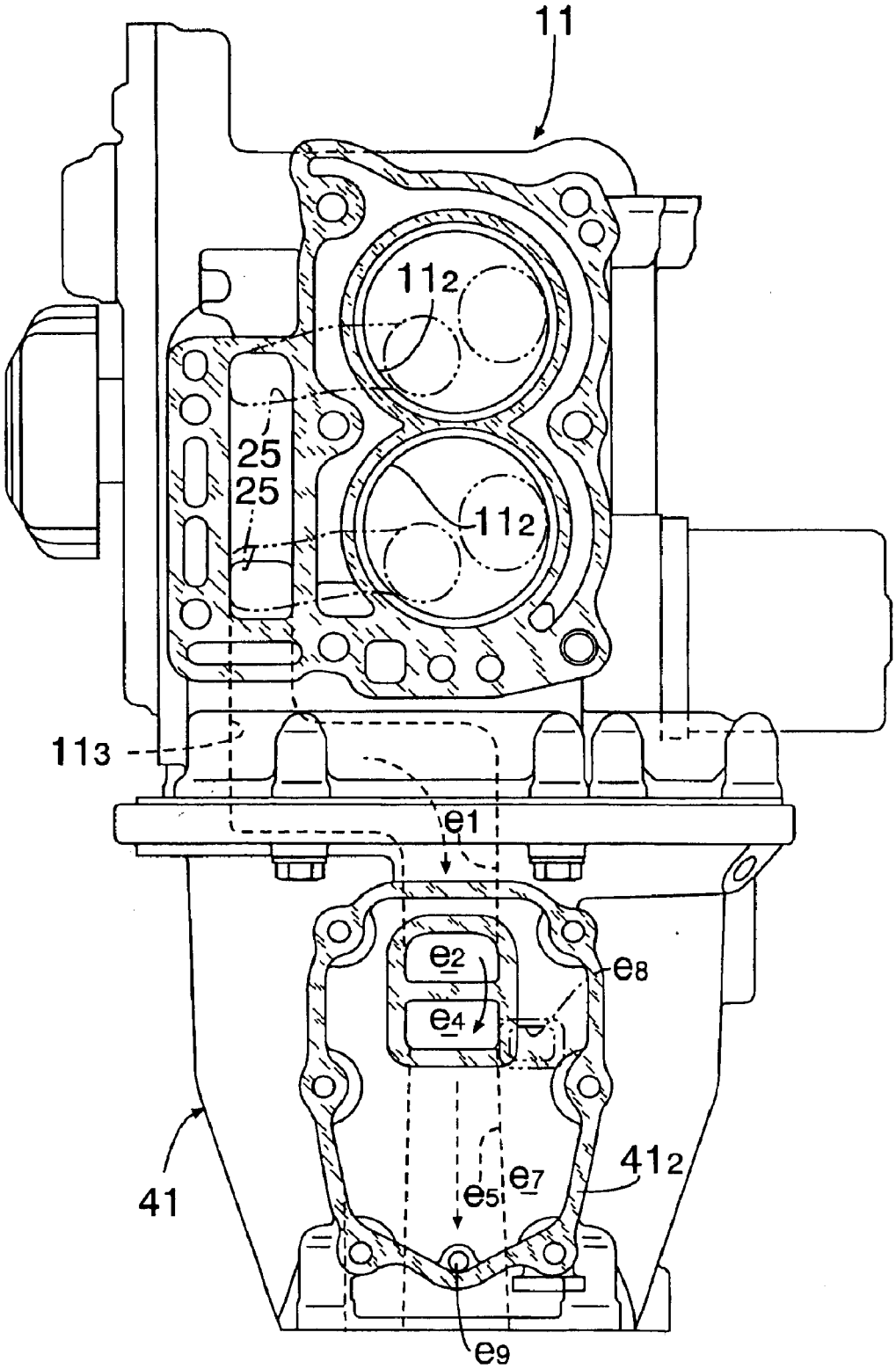
Figure 7:
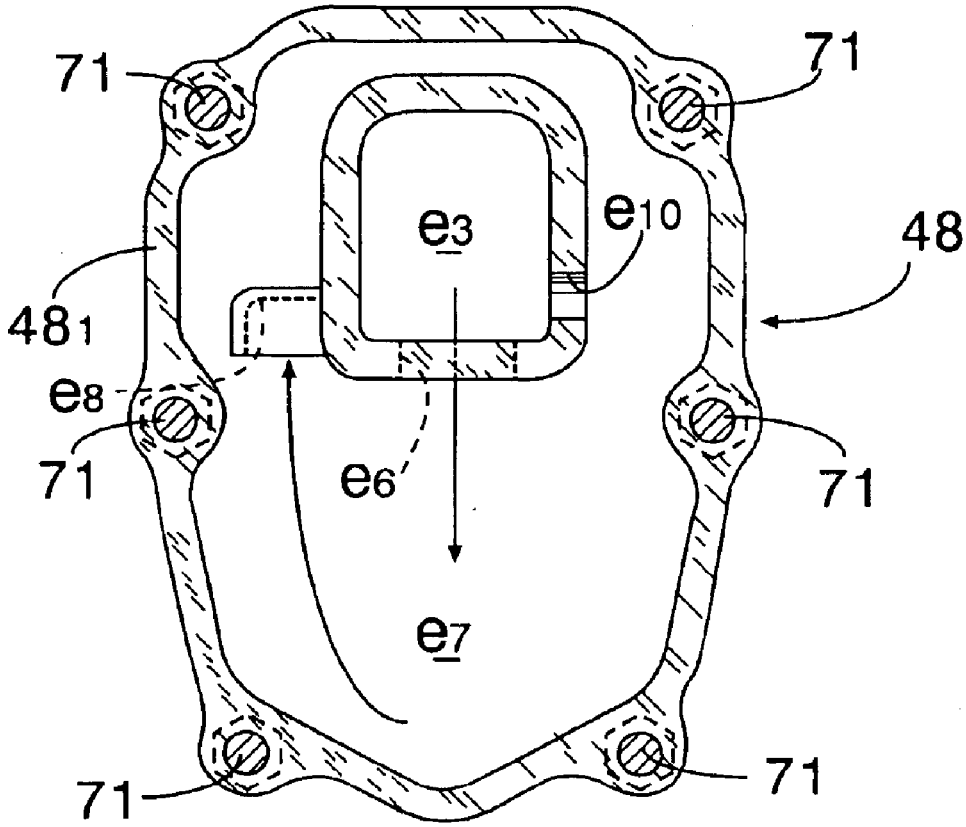

As can be seen from FIGS. 5 to 7, the exhaust passage-defining member 48 is coupled to the oil case 41 by six bolts 71 in a state in which a split face $\mathbf{48}_1$ formed in a front surface of the exhaust passage-defining member 48 is in abutment against a split face $\mathbf{41}_2$ formed on the rear surface of the oil case 41. An exhaust gas discharged from the exhaust port 25 in the engine E flows through a main exhaust passage $\mathbf{11}_3$ defined in the engine block 11 into a first main exhaust passage $e_1$ defined in the oil case 41 (see an arrow a in FIG. 4) and then flows therefrom through a communication bore $e_2$ into a main exhaust gas expansion chamber $e_3$ defined between the exhaust passage-defining member 48 and the oil case 41. The exhaust gas in the main exhaust gas expansion chamber $e_3$ flows through a communication bore $e_4$ into a second main exhaust passage $e_5$ defined in the oil case 41; flows therefrom via the exhaust gas expansion chamber 49 defined in the extension case 42, the inside of the gear case 43 and a hollow around a propeller shaft 53 (which will be described hereinafter), and is discharged into the outside water. On the other hand, a portion of the exhaust gas in the main exhaust gas expansion chamber $e_3$ in the exhaust passage-defining member 48 flows through a communication bore $e_6$ into a subsidiary exhaust gas expansion chamber $e_7$ defined between the exhaust passage-defining member 48 and the oil case 41, and is discharged therefrom through an exhaust gas outlet $e_8$ into the air. A drainage bore $e_9$ is defined in a lower end of the subsidiary exhaust gas expansion chamber $e_7$ for discharging water accumulated in the subsidiary exhaust gas expansion chamber $e_7$ into the second main exhaust passage $e_5$ in the oil case 41. The main exhaust gas expansion chamber $e_3$ and the subsidiary exhaust gas expansion chamber $e_7$ communicate with each other through a pressure relief bore $e_{10}$.

The main exhaust gas expansion chamber $e_3$ and the subsidiary exhaust gas expansion chamber $e_7$ are defined between the oil case 41 and the exhaust passage-defining member 48 coupled to a sidewall of the oil case 41, as described above and hence, the degree of freedom for designing the exhaust gas expansion chambers can be increased to enhance the exhaust silencing effect, as compared with a case where exhaust gas expansion chambers are defined in the narrow oil case 41. Moreover, the main exhaust gas expansion chamber $e_3$ and the subsidiary exhaust gas expansion chamber $e_7$ can be exposed for the maintenance only by separating the exhaust passage-defining member 48 from the oil case 41 without separation of the oil case 41 from the engine block 11 and the extension case 42, leading to a remarkably enhanced maintenance property. Further, the main exhaust gas expansion chamber $e_3$ and the subsidiary exhaust gas expansion chamber $e_7$ cannot interfere with the oil pan $\mathbf{41}_1$ mounted within the oil case 41 and hence, it is possible to reconcile the ensuring of a volume of the oil pan $\mathbf{41}_1$ and the ensuring of volumes of the main exhaust gas expansion chamber $e_3$ and the subsidiary exhaust gas expansion chamber $e_7$.

Figure 8:
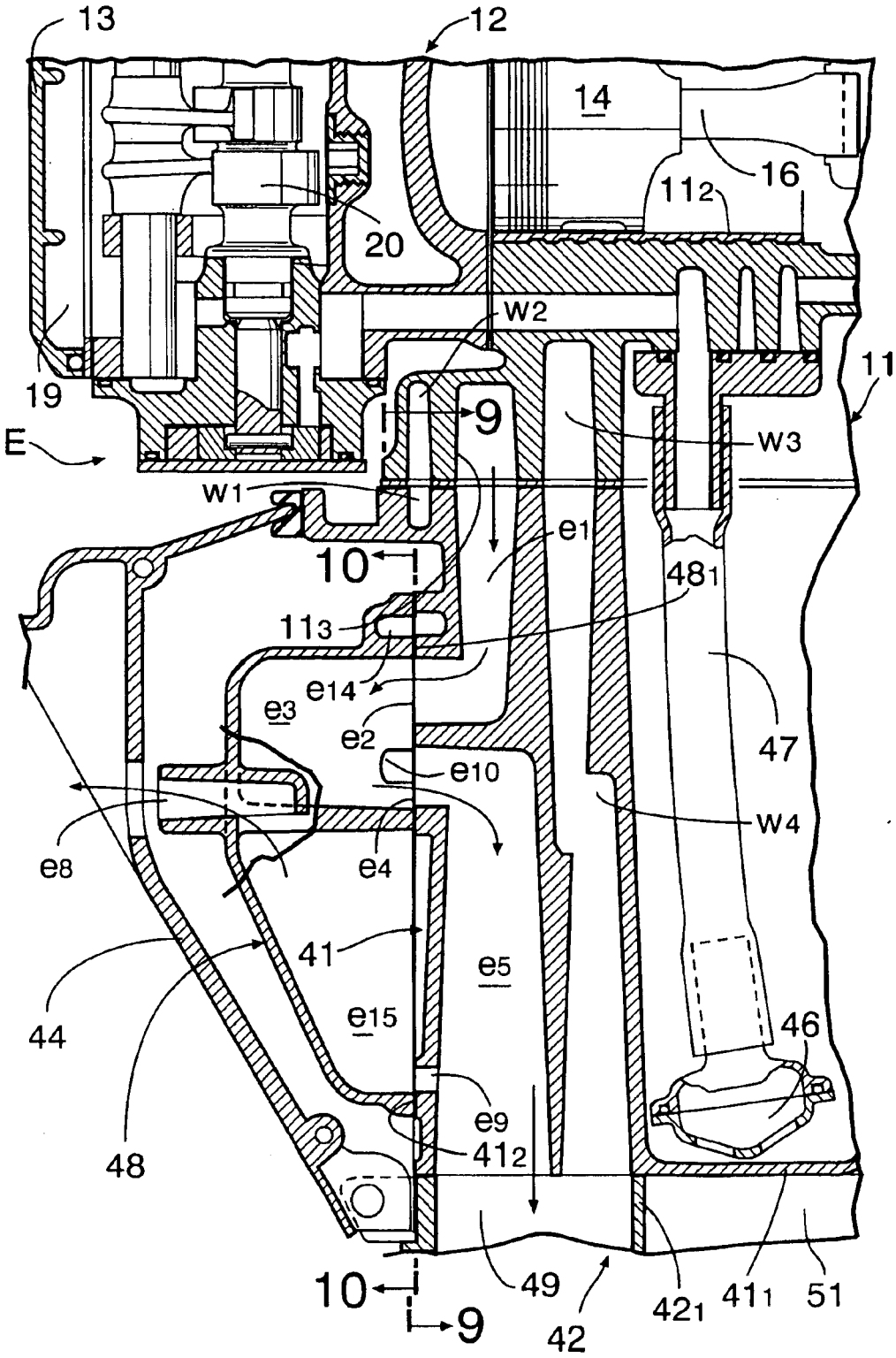
Figure 9:
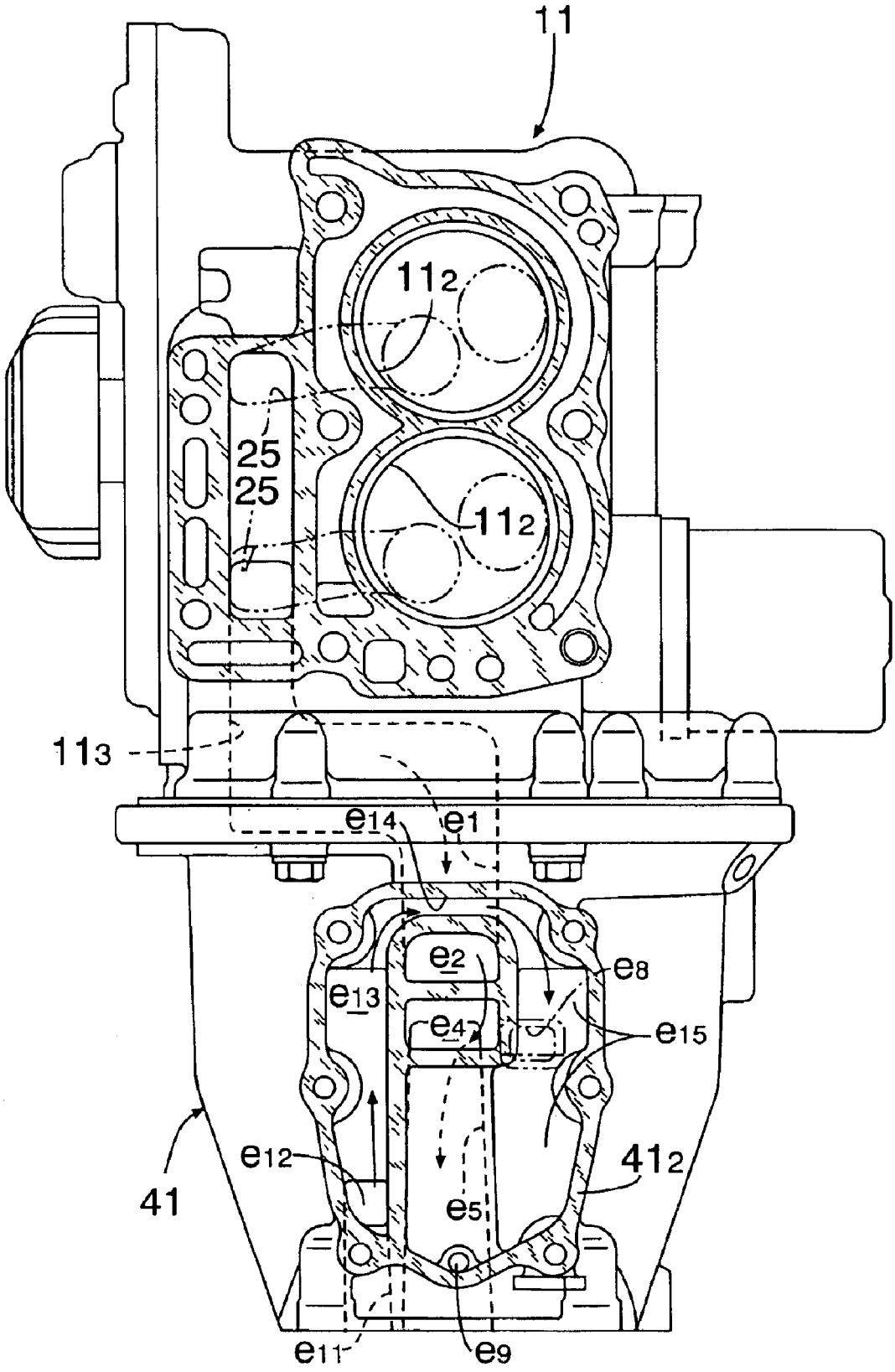
Figure 10:
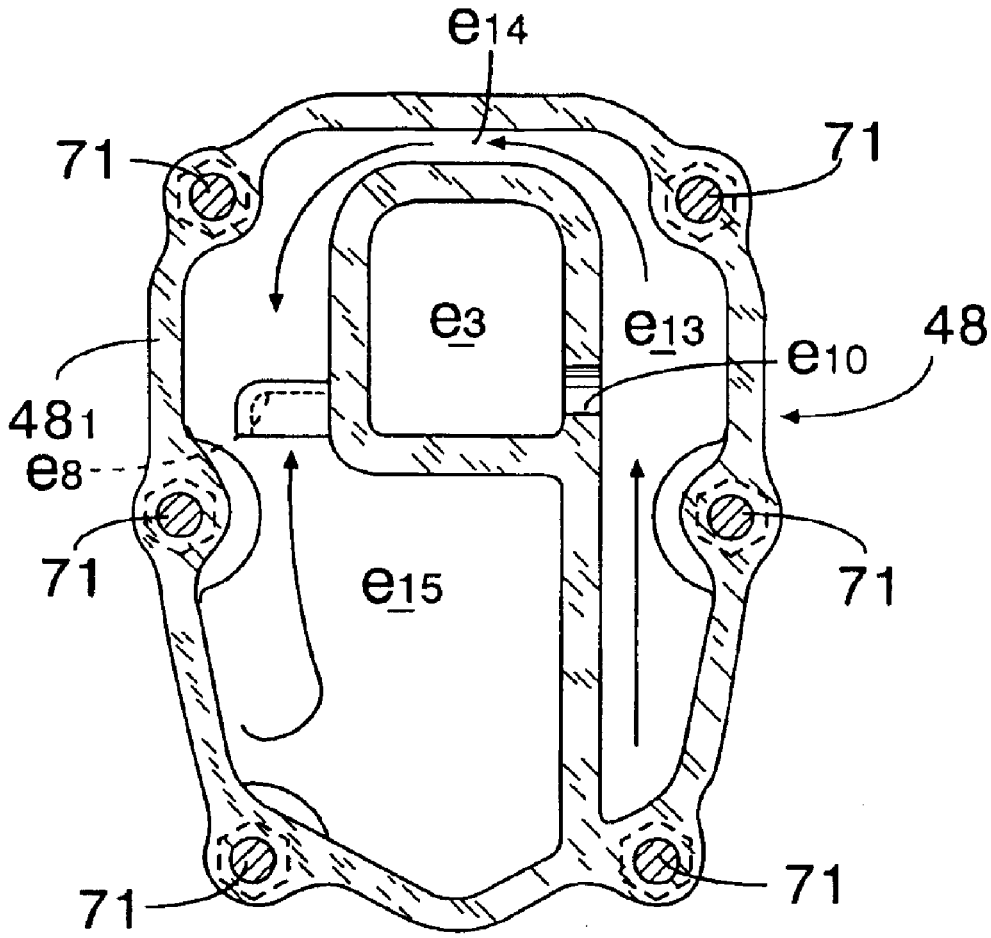

A second embodiment of the present invention will now be described with reference to FIGS. 8 to 10.

The second embodiment is different in an exhaust passage structure from the first embodiment. An exhaust gas discharged from the exhaust port 25 flows through a main exhaust passage $\mathbf{11}_3$ defined in the engine block 11 into a first main exhaust gas passage $e_1$ defined in the oil case 41, and flows therefrom through a communication bore $e_2$ into a main exhaust gas expansion chamber $e_3$ defined between the exhaust passage-defining member 48 and the oil case 41. The exhaust gas in the main exhaust gas expansion chamber $e_3$ flows through a communication bore $e_4$ into a second main exhaust passage $e_3$ defined in the oil case 41 and is discharged therefrom into the exhaust gas expansion chamber 49 in the extension case 42.

A subsidiary exhaust passage $e_{11}$ is defined in parallel on the left of the second main exhaust passage $e_5$ to extend upwards from the exhaust gas expansion chamber 49 in the extension case 42. The subsidiary exhaust passage $e_{11}$ communicates with a first subsidiary exhaust gas expansion chamber $e_{13}$ defined between the exhaust passage-defining member 48 and the oil case 41 through a communication bore $e_{12}$. The first subsidiary exhaust gas expansion chamber $e_{13}$ communicates with a second subsidiary exhaust gas expansion chamber $e_{15}$ defined between the oil case 41 and the exhaust passage-defining member 48 via a narrow portion $e_{14}$ defined between the oil case 41 and the exhaust passage-defining member 48 and having a throttling effect. The second subsidiary exhaust gas expansion chamber $e_{15}$ communicates with an exhaust outlet $e_8$ provided in the rear surface of the exhaust passage-defining member 48. A lower end of the second subsidiary exhaust gas expansion chamber $e_{15}$ communicates with the second main exhaust passage $e_5$ through a drainage bore $e_9$, and the main exhaust gas expansion chamber $e_3$ and the first subsidiary exhaust gas expansion chamber $e_{13}$ communicate with each other through a negative-pressure relief bore $e_{10}$ defined in the exhaust passage-defining member 48.

Even according to the second embodiment, functions and effects similar to those in the first embodiment can be achieved. Particularly, the exhaust silencing effect can be further enhanced, because the first subsidiary exhaust gas expansion chamber $e_{13}$ and the second subsidiary exhaust gas expansion chamber $e_{15}$ are provided within the exhaust passage-defining member 48 with the narrow portion $e_{14}$ having the throttling effect interposed therebetween.

A third embodiment of the present invention will now be described with reference to FIGS. 11 to 15.

Figure 11:
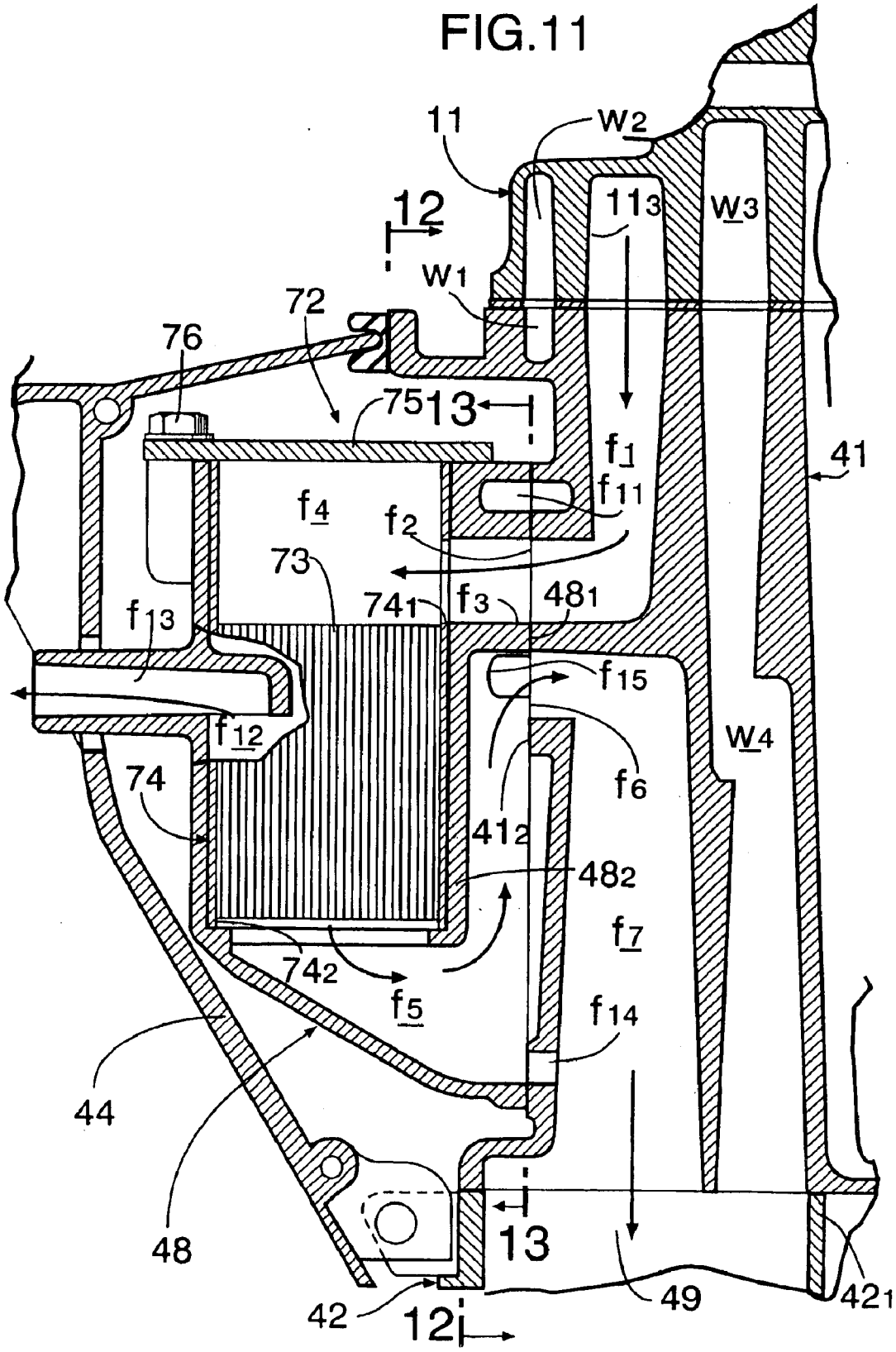
Figure 12:
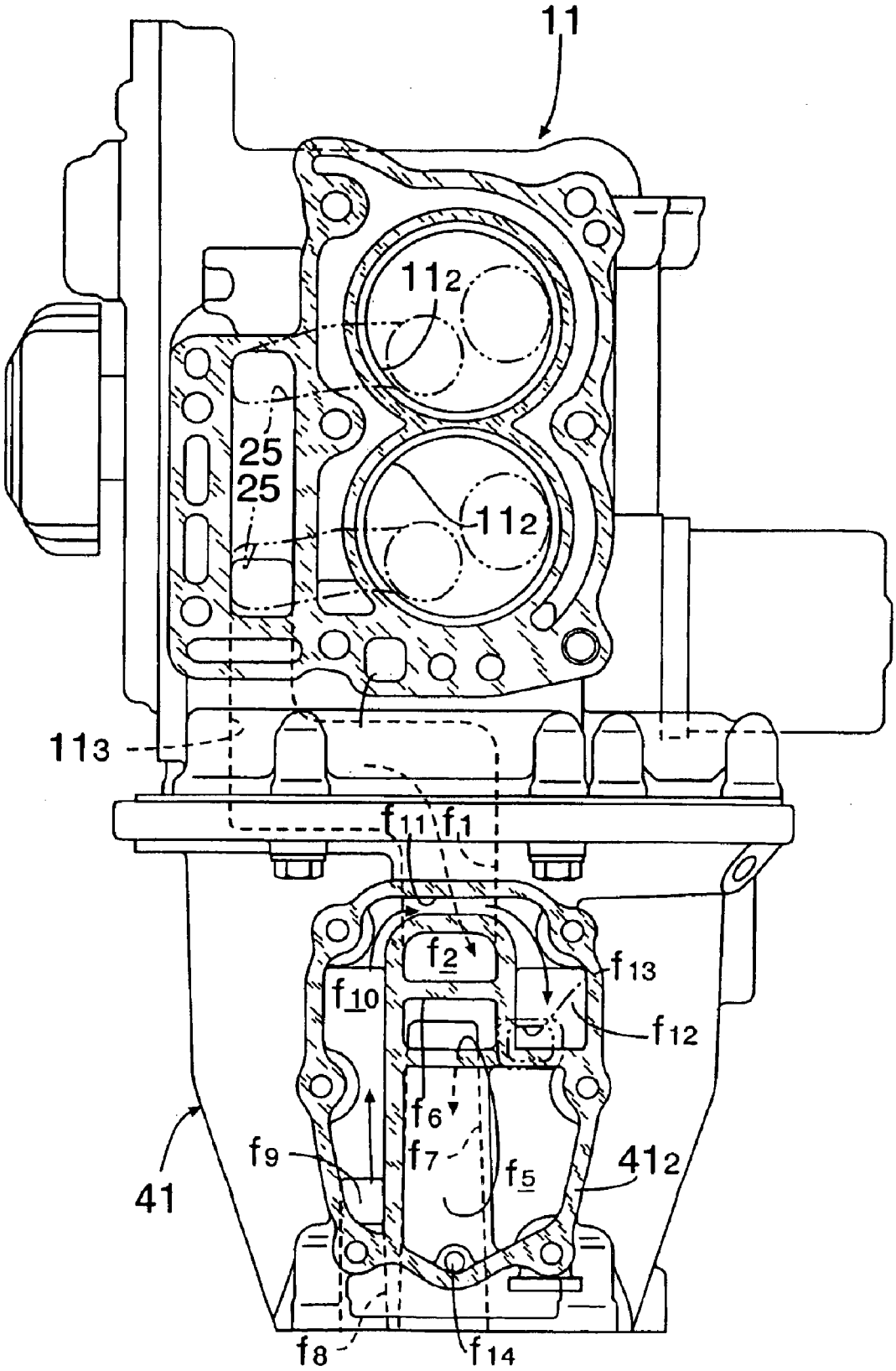
Figure 13:
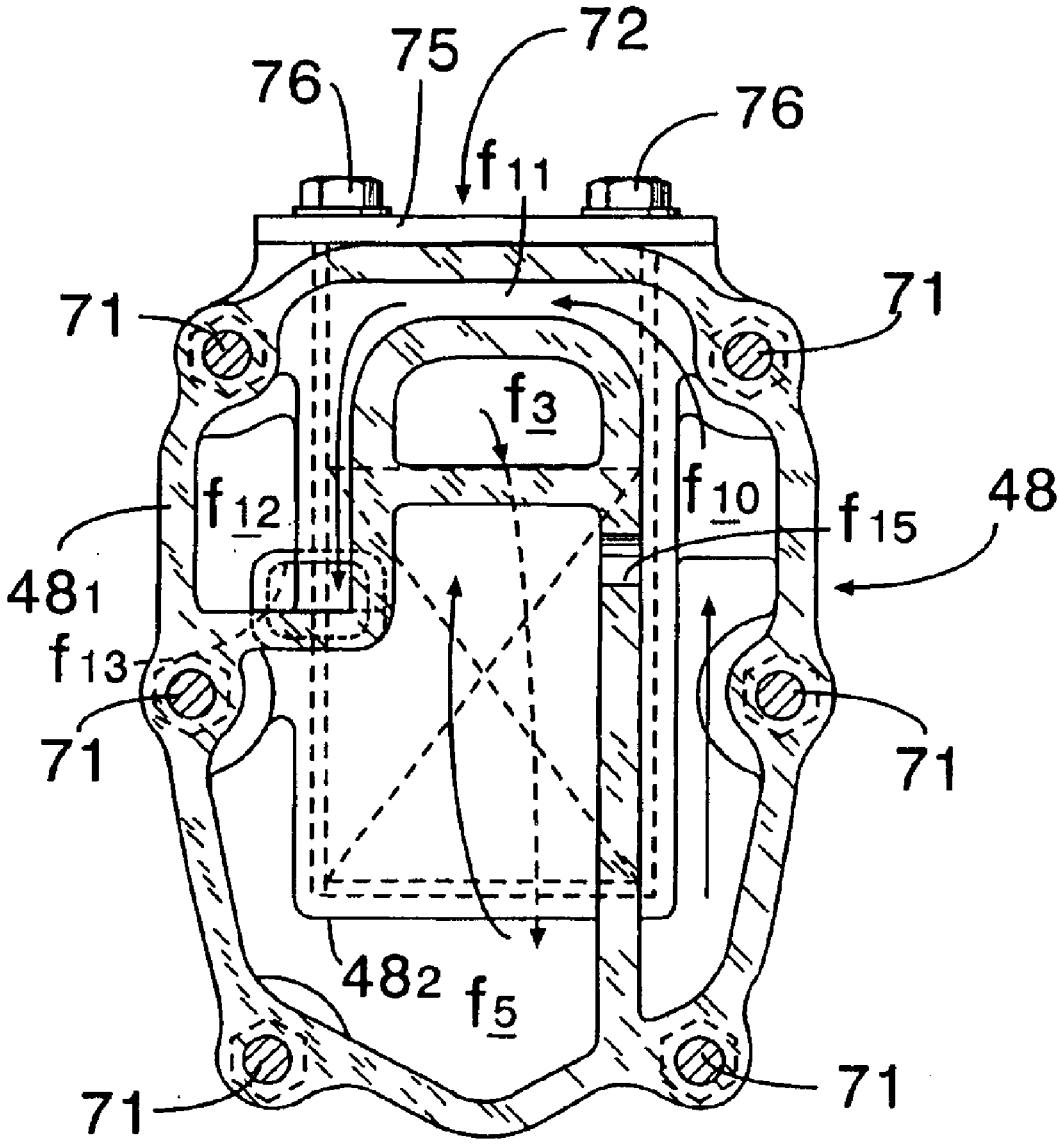

As can be seen from FIGS. 11 to 13, an exhaust passage-defining member 48 is coupled to an oil case 41 by six bolts 71 in a state in which a split face 48, formed on a front surface of the exhaust passage-defining member 48 is in abutment against a split face $\mathbf{41}_2$ formed on a rear surface of the oil case 41. A cylindrical catalytic converter-supporting portion $\mathbf{48}_2$ with upper and lower surfaces opened is formed within the exhaust passage-defining member 48, and a catalytic converter 72 is supported in the catalytic converter-supporting portion $\mathbf{48}_2$.

Figure 14:
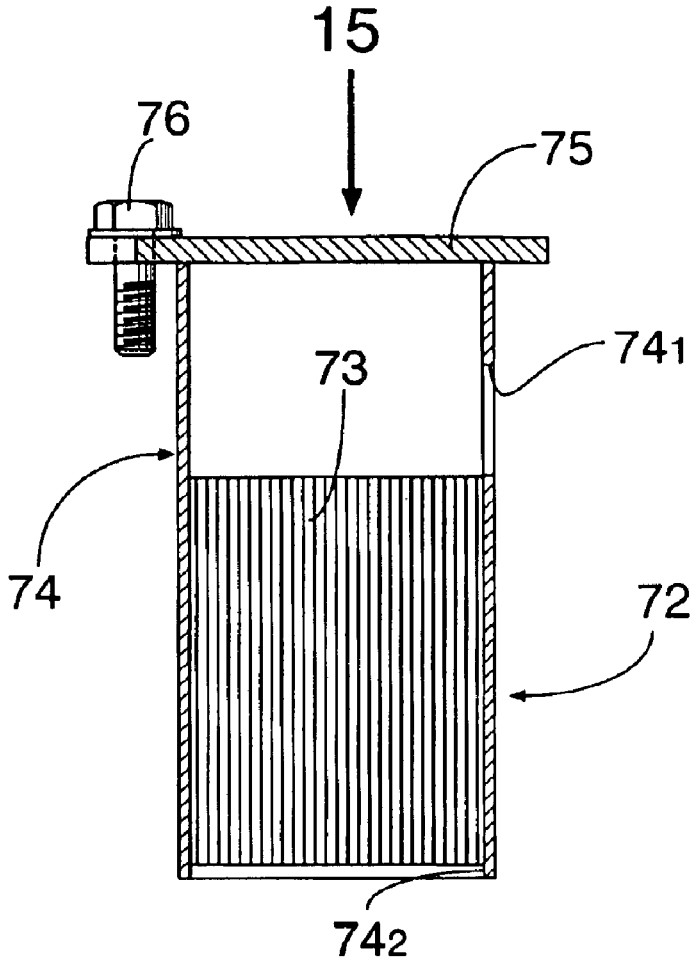
Figure 15:
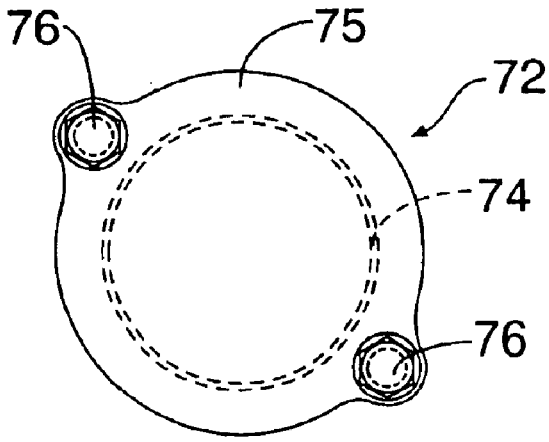

As can be seen from FIGS. 14 and 15, the catalytic converter 72 includes a catalyst carrier 73 formed into a columnar shape and having a honeycomb section, a cylindrical case 74 having the catalyst carrier 73 accommodated therein, and a flange 75 which closes an upper surface of the cylindrical case 74. The catalytic converter 72 is fixed by fitting the cylindrical case 74 into the catalytic converter-supporting portion $\mathbf{48}_2$ of the exhaust passage-defining member 48 from above and fastening two bolts 76, 76 passed through the flange 75 to the catalytic converter-supporting portion $\mathbf{48}_2$. An exhaust gas inlet $\mathbf{74}_1$ is defined in one side of an upper portion of the cylindrical case 74, and an exhaust gas outlet $\mathbf{74}_2$ is defined in a lower surface of the cylindrical case 74.

An exhaust gas discharged from the exhaust port 25 in the engine E flows through a main exhaust passage $\mathbf{11}_3$ defined in the engine block 11 into a first main exhaust passage $t_1$ defined in the oil case 41, and flows therefrom through a communication bore $t_2$ defined in the oil case 41, a second main exhaust passage $t_3$ defined in the exhaust passage-defining member 48 and the exhaust gas inlet $\mathbf{74}_1$ in the cylindrical case 74 of the catalytic converter 72 into a space $t_4$ above the catalyst carrier 73. The exhaust gas passed from the space $t_4$ downwards through the catalyst carrier 73 and thus purified flows through the exhaust gas outlet $\mathbf{74}_2$ in the cylindrical case 74, an opening in a lower surface of the catalytic converter-supporting portion $\mathbf{48}_2$ into a main exhaust gas expansion chamber $t_5$ defined between the oil case 41 and the exhaust passage-defining member 48, and further flows from an upper portion of the main exhaust gas expansion chamber $t_5$ through a communication bore $t_6$ defined in the oil case 41, and is discharged into the exhaust gas expansion chamber 49 in the extension case 42.

A subsidiary exhaust passage $t_8$ is defined in parallel on the left of the third main exhaust passage $t_7$ to extend upwards from the exhaust gas expansion chamber 49 in the extension case 42. The exhaust gas flowing upwards in the subsidiary exhaust passage $t_8$, continues flowing through a communication bore $t_9$ defined in the oil case 41, a first subsidiary exhaust gas expansion chamber $t_{10}$ defined between the oil case 41 and the exhaust passage-defining member 48, a narrow portion $t_{11}$, which produces a throttling effect, continuing into a second subsidiary exhaust gas expansion chamber $t_{12}$, and is discharged into the air through an exhaust outlet $t_{13}$, provided in the rear surface of the exhaust passage-defining member 48. A lower end of the main exhaust gas expansion chamber $t_5$ communicates with the third main exhaust gas expansion chamber $t_7$ through a drainage bore $t_{14}$, and the main exhaust gas expansion chamber $t_5$ and the first subsidiary expansion chamber $t_{10}$ communicate with each other through a negative-pressure relief bore $t_{15}$ defined in the exhaust passage defining member 48.

To carry out the maintenance of the catalytic converter 72, first, the undercover 44 is removed, and the exhaust passage-defining member 48 fixed by the six bolts 71 to the rear surface of the oil case 41 is separated. Then, the catalytic converter 72 fixed by the two bolts 76, 76 is separated from the exhaust passage-defining member 48, whereby the maintenance of the catalytic converter 72 can be carried out.

The catalytic converter 72 is disposed in the space surrounded by the oil case 41 and the exhaust passage-defining member 48 detachably mounted to the rear surface of the oil case 41, as described above, and hence, the catalytic converter 72 can be exposed only by removing the exhaust passage-defining member 48 from the oil case 41. Therefore, the catalytic converter 72 can be subjected simply to the maintenance without conduction of a troublesome operation for separating the engine block 11 and the extension case 42 from the oil case 41. If the catalytic converter 72 is mounted within the oil case 41, it is difficult to ensure a space for the maintenance of the catalytic converter 72, because the oil pan $\mathbf{41}_1$ is a hindrance. In the present embodiment, however, the catalytic converter 72 can be exposed and subjected to the efficient maintenance so as not to be hindered by the oil pan $\mathbf{41}_1$.

Further, the catalytic converter 72 is supported on the exhaust passage-defining member 48 and hence, a subassembly can be constructed by the catalytic converter 72 and the exhaust passage-defining member 48. As a result, the catalytic converter 72 can be separated together with the exhaust passage-supporting member 48 from the inner case 41, leading to not only a further enhancement in maintenance property but also an enhancement in handleability and assemblability of the catalytic converter 72.

Although the embodiments of the present invention have been described in detail, it will be understood that various modifications in design may be made without departing from the subject matter of the invention defined in claims.

For example, the catalytic converter 72 disposed in the space surrounded by the oil case 41 and the exhaust passage-defining member 48 is supported on the exhaust passage-defining member 48 in the third embodiment, but it can be supported on the oil case 41. With such arrangement, even if the exhaust passage-defining member 48 is separated from the oil case 41, the exhaust passage leading to the catalytic converter 72 is not cut off and hence, the seal structure for the exhaust passage can be simplified.

INDUSTRIAL APPLICABILITY

As described above, the exhaust passage structure in the outboard engine system according to the present invention is preferably applicable to an outboard engine system in which at least a portion of an exhaust passage is integrally defined in a case member 41 having a drive shaft 50 accommodated therein for transmitting a driving force from an engine E to a propeller 52, and to an outboard engine system in which a catalytic converter 72 for purifying an exhaust gas discharged from an engine E is mounted in an exhaust passage for guiding the exhaust gas.

What is claimed is:

1. An exhaust passage structure in an outboard engine system, in which at least a portion of an exhaust passage means is integrally formed in a case member having a drive shaft accommodated therein for transmitting a driving force from an engine to a propeller, wherein openings of said exhaust passage means are defined in a generally upwardly and downwardly extending sidewall of said case member which is disposed under an engine block, and an exhaust passage forming an exhaust silencing portion is defined between said case member and a lid which is detachably coupled to said sidewall of said case member to cover said openings.

2. An exhaust passage structure in an outboard engine system according to claim 1, wherein an oil pan for storing a lubricating oil for the engine is integrally formed within said case member.

3. An exhaust passage structure in an outboard engine system, in which at least a portion of an exhaust passage means is integrally formed in a case member having a drive shaft accommodated therein for transmitting a driving force from an engine to a propeller;

wherein openings of said exhaust passage means are defined in a generally upwardly and downwardly extending sidewall of said case member which is disposed under an engine block, and an exhaust passage forming an exhaust silencing portion is defined between said case member and a lid which is detachably coupled to said sidewall of said case member to cover said openings.

4. The outboard engine system of claim 3, wherein an oil pan for storing a lubricating oil for the engine is integrally formed within the case member.

5. An exhaust passage structure in an outboard engine system having a swivel shaft for steering of the outboard engine system in which a catalytic converter for purifying an exhaust gas discharged from an engine is mounted in an exhaust passage for guiding the exhaust gas, the exhaust passage structure comprising:

at least a portion of the exhaust passage integrally formed in a case member, the case member being disposed under an engine block to accommodate a drive shaft therein for transmitting a driving force from the engine to a propeller, said case member being connected to said swivel shaft;

a connection into which said exhaust passage opens, the connection being formed in a sidewall of said case member; and an exhaust passage-defining member being disposed under the engine block;

wherein said catalytic converter is disposed in a space surrounded by the case member and the exhaust passage-defining member so as to be held by the exhaust passage-defining member, the exhaust passage-defining member being detachably coupled to said connection of the case member to permit the exhaust gas to flow thereinto.

6. An exhaust passage structure in an outboard engine system according to claim 5, wherein said catalytic converter is supported on said exhaust passage-defining member.

7. An exhaust passage structure in an outboard engine system according to claim 5, wherein said catalytic converter receives the exhaust gas flow from said case member via an opening in said exhaust passage-defining member communicating with the connection.

8. An exhaust passage structure in an outboard engine system having a swivel shaft for steering of the outboard engine system in which a catalytic converter for purifying an exhaust gas discharged from a 4-cycle engine is mounted in an exhaust passage for guiding the exhaust gas, the exhaust passage structure comprising:

at least a portion of the exhaust passage integrally formed in a case member, the case member being disposed under an engine block to accommodate a drive shaft therein for transmitting a driving force from the engine to a propeller, said case member being connected to said swivel shaft;

a connection into which said exhaust passage opens formed in a sidewall of said case member; and an exhaust passage-defining member disposed under the engine block;

wherein said catalytic converter is disposed in a space surrounded by the case member and the exhaust passage-defining member so as to be held by the exhaust passage defining member, the exhaust passage defining member being detachably coupled to said connection of the case member; and wherein said exhaust passage-defining member includes an opening to permit the exhaust gas to flow thereinto.

* * * * *